US005280905A

United States Patent [19]

Micco

[11] Patent Number: 5,280,905

[45] Date of Patent: Jan. 25, 1994

[54] ELECTRONIC FOOTBALL BLOCKING AND TACKLING DUMMY

[76] Inventor: James Micco, 2 Hanson Pl., Huntington, N.Y. 11743

[21] Appl. No.: 46,603

[22] Filed: Apr. 12, 1993

[51] Int. Cl.[5] ..... A63B 69/34

[52] U.S. Cl. ..... 273/55 A; 482/84; 482/85; 482/86; 482/87; 482/90

[58] Field of Search ..... 273/55 A; 284/83, 84, 284/85, 86, 87, 90

[56] References Cited

U.S. PATENT DOCUMENTS

| | | | |
|---|---|---|---|
| 2,904,337 | 9/1959 | Canning | 273/55 A |
| 3,384,372 | 5/1968 | Dickenson | 273/55 A |
| 3,416,795 | 12/1968 | Lewis et al. | 273/55 A |
| 3,446,696 | 9/1969 | Hooker | 273/55 R |
| 3,556,523 | 1/1971 | Hooker | 273/55 R |
| 3,700,237 | 10/1972 | Kopp | 273/55 A |
| 4,088,315 | 5/1978 | Schemmel | 482/83 |
| 4,201,379 | 5/1980 | Williams | 482/84 |
| 4,208,048 | 6/1980 | Winterbottom | 482/86 |
| 4,268,030 | 5/1981 | Richards | 482/86 |
| 4,330,119 | 5/1982 | Marshall, Jr. | 482/84 |
| 4,387,892 | 6/1983 | Wen | 482/83 |
| 4,401,303 | 8/1983 | Anderson | 482/83 |
| 4,534,557 | 8/1985 | Bigelow | 273/55 A |
| 4,770,412 | 9/1988 | Wolfe | 482/86 |
| 4,824,414 | 4/1989 | Goldblall | 446/226 |
| 4,869,503 | 9/1989 | Grasso | 213/55 A |
| 4,883,271 | 11/1989 | French | 482/83 |
| 4,974,833 | 12/1990 | Hartman | 482/84 |
| 5,110,123 | 5/1992 | Micco | 273/55 A |

FOREIGN PATENT DOCUMENTS

| | | | |
|---|---|---|---|
| 1657213 | 6/1991 | U.S.S.R. | 482/85 |

*Primary Examiner*—Theatrice Brown
*Attorney, Agent, or Firm*—Richard L. Miller

[57] ABSTRACT

A football blocking and tackling dummy for the practice of football skills has an illustration of a football player on the front thereof. A force sensitive switch is located within the dummy vertically between the knees and waist of the illustrated player. A mercury switch is located above the waist of the dummy at an angle. A block or tackle of the dummy in the preferred zone will actuate the force sensitive switch and a sound output will be produced. Hitting the dummy too high will open the mercury switch and prevent the sound output from being produced.

8 Claims, 2 Drawing Sheets

FIG. 1
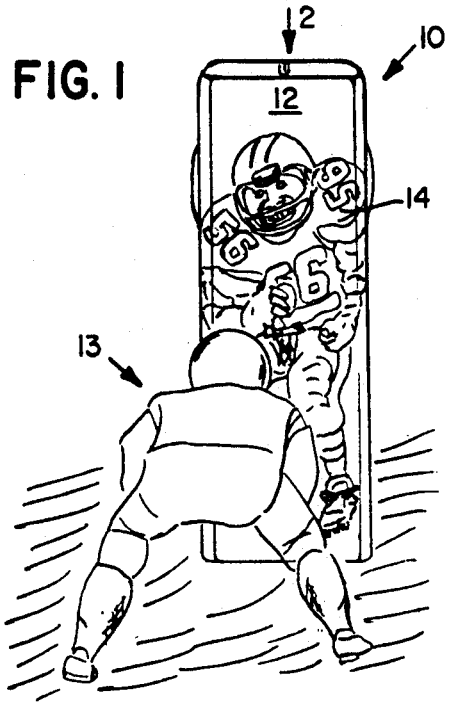
FIG. 2
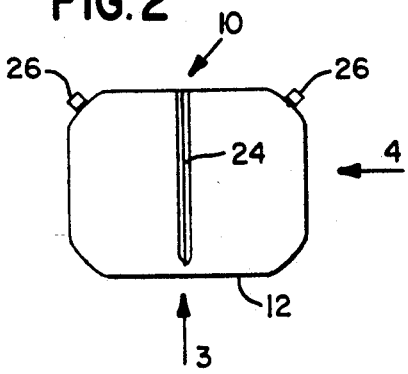
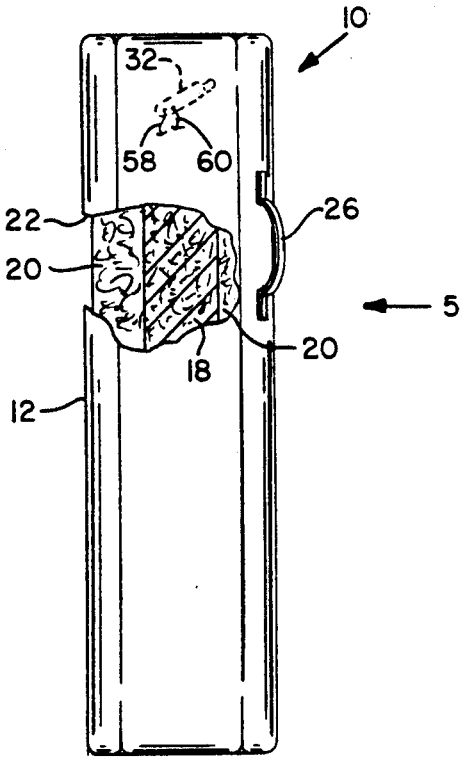
FIG. 4
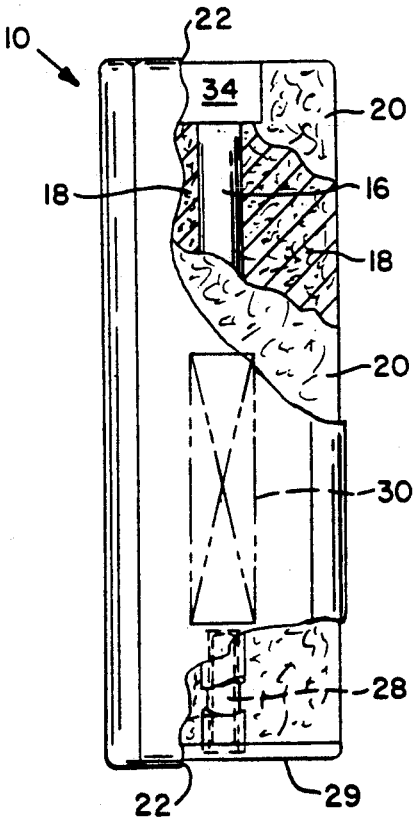
FIG. 3

FIG. 5
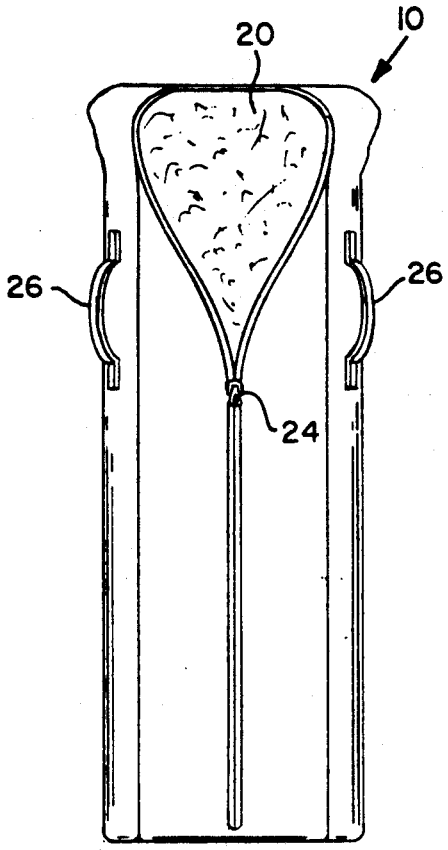
FIG. 7
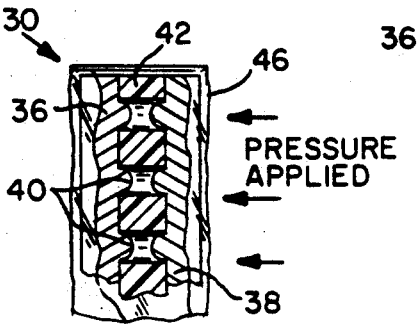
FIG. 6
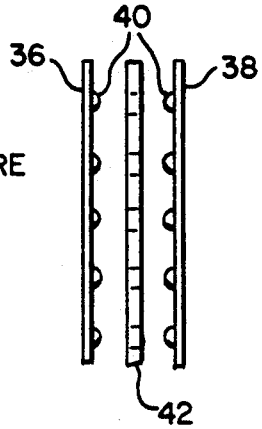
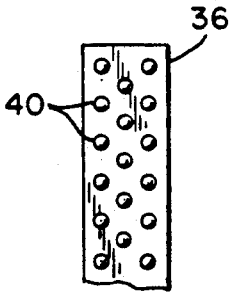
FIG. 8
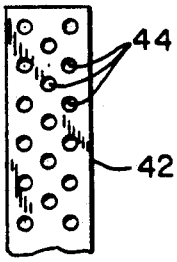
FIG. 9
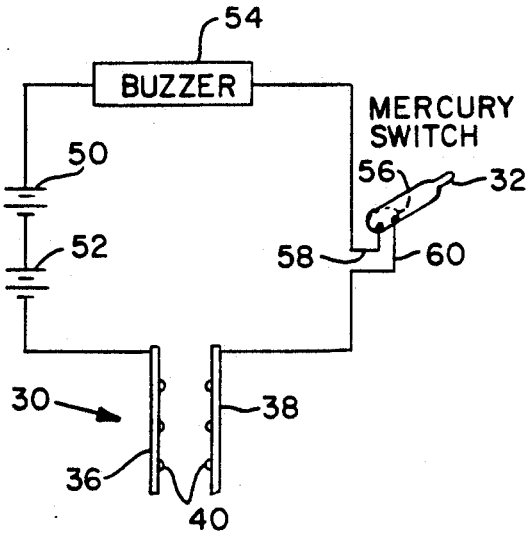
FIG. 10
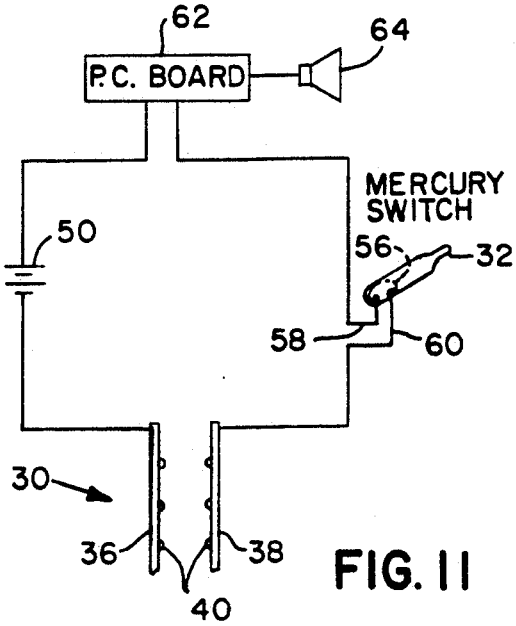
FIG. 11

ELECTRONIC FOOTBALL BLOCKING AND TACKLING DUMMY

BACKGROUND OF THE INVENTION

1. Field of the Invention

This invention relates to a blocking and tackling dummy used for teaching desirable football skills to athletes during practice. More specifically, this invention relates to a practice dummy which is rugged and lightweight, and which contains electronic circuitry providing immediate positive feedback to a player who blocks or tackles the dummy in a preferred zone between the knees and waist, but will not respond when hit above the waist.

2. Description of the Prior Art

Over the years coaches have struggled with the problem of getting inexperienced or young athletes to block and tackle in a good, low football position. The natural tendency of a young player is to stand up when coming out of a three point stance, or to hit high when tackling. The present invention uses positive reinforcement in the form of a buzzer or a simulated human voice which sounds when the dummy is hit properly in order to assist young players to eliminate bad habits and develop consistency in repeating proper techniques of blocking and tackling. The players will be more likely to repeat in a game situation the techniques performed repeatedly in practice.

SUMMARY OF THE INVENTION

An unexpected result of the dummy is that peer pressure adds to its effectiveness. When used with young players, none of them wants to be the one who fails to sound the buzzer.

Another advantage of this invention is its shape which presents two flat surfaces representing the front of an opposing player's thighs, the other the back of the legs. This allows a player to "square up" when approaching the block and provides a surface for pulling into the body on tackling drills. The dummy, unlike bell shaped or conical dummies, is shaped in a form representing a real player, and is configured to represent the distance a player's arm must extend and cover when making a sound block or tackle.

Use of a dummy protects young players by minimizing the number of repetitious one-on-one live tackling drills.

In accordance with the present invention there is disclosed a tackling dummy having a rigid internal tube structure surrounded by multiple layers of foam of differing densities to provide a practice dummy having considerable strength for long life yet moderate weight to enhance portability. A rugged, flexible cover of canvas or the like having a zippered closure covers the dummy, and has imprinted on the outside cover thereof a full size illustration of a football player. A weight in the bottom of the dummy provides stability, and can be varied to suit the weight of the users of the dummy.

The heart of the invention is an electromechanical sensor switch consisting of a sandwich structure made of two flexible parallel metal plates separated by a compressible electrically insulating foam layer. Each plate has a plurality of raised projections thereon facing a like projection on the opposite plate. The foam layer between the plates has holes between facing projections. The switch is located with the dummy and extends vertically approximately between the knees and the waist of the illustrated football player. This zone is the preferred zone for hitting an opposing player. A block or tackle in this preferred zone will produce a force that causes contact between projections extending from the two plates. The contact actuates an electrical circuit which produces a sensory output such as a horn, or a simulated human voice that is grunting. This immediate positive feedback encourages proper technique, particularly among young football players.

A further novel feature of this invention is a mercury-type switch located above the sensor switch at an angle such as 30 degrees relative to the ground. The mercury switch is only actuated when a user hits the dummy above the preferred zone resulting in the dummy tipping backward of falling on the ground. Actuation of the mercury switch will prevent the sensory output from being produced even if the user thereafter slips down on or falls on the sensor switch. Thus, no reinforcement of improper or undesirable technique will occur.

A number of prior art devices show foot ball dummy apparatus useful for practice including a previous patent application Ser. No. 07/710,745 filed May 31, 1991, now abandoned and Issued U.S. Pat. No. 5,110,124 both by the present applicant. Other prior art devices include the following U.S. Pat. Nos. 2,192,873 to Turrall; 2,904,337 to Canning; 3,384,372 to Dickens; 3,416,795 to Lewis et al; 3,464,696 to Hooker; 3,556,523 to Hooker; 3,659,874 to Gow; 3,680,861 to Schmidt; 3,700,237 to Kopp; 4,088,315 to Schemmel; 4,387,892 to Wen; 4,401,303 to Anderson et al; 4,534,557 to Bigelow et al; 4,824,414 to Goldblatt;. 4,869,503 to Grasso; and 4,883,271 to French. See also German Patentschrift 380371.

A number of the referenced prior art devices show football dummies of well known construction, or devices which provide an output signal when struck in a particular manner. None of the references, however, either singly or in combination, teach or suggest a football dummy as described herein which produces as an output a sound or other indicia of success when blocked or tackled in a desired location or preferred zone, in combination with a switch which will deactivate the sensory output if the dummy is not blocked or tackled as desired even if the dummy is toppled and hit in the desired location immediately thereafter.

It is therefore an object of this invention to provide a unique football dummy which provides immediate positive feedback to a user when a desired blocking or tackling technique is used.

A further object of this invention is a blocking and tackling dummy producing a sensory output simulating a human voice grunting when the dummy is appropriately blocked or tackled.

Another object of this invention is a football dummy which will produce a sensory output when hit in a predetermined area, but which will not produce such output if such hit is the result of improper or undesirable technique.

A still further object of this invention is a football dummy having a uniquely constructed force-responsive sensor switch and a mercury switch so located as to provide a sensory output to a user only when a proper football blocking or tackling technique has been used and the dummy hit in a desired or preferred zone.

DESCRIPTION OF THE DRAWINGS

FIG. 1 is a diagrammatic frontal perspective view of the present invention in use;

FIG. 2 is a top plan view taken in the direction of arrow 2 of FIG. 1;

FIG. 3 is a front elevational view with the outer cover broken away showing some parts in section in the direction of arrow 3 of FIG. 2;

FIG. 4 is a side elevational view with the outer cover partially broken away showingsome parts in section in the direction of arrow 4 of FIG. 2;

FIG. 5 is a rear view of the invention with the cover partially open in the direction of arrow 5 of FIG. 4;

FIG. 6 is a diagrammatic exploded side elevational view with parts broken away showing the pressure sensitive switch of the present invention;

FIG. 7 is an enlarged partially sectioned assembled view of the pressure sensitive switch enclosed in a plastic bag.

FIG. 8 is a partial elevational view of the two outer elements of the pressure sensitive switch;

FIG. 9 is a partial elevational view of the insulating foam element separating the two outer elements of the pressure sensitive switch;

FIG. 10 is a block diagram of the electrical circuitry of one embodiment of this invention; and FIG. 11 is a block diagram of the electrical circuitry of a second embodiment of this invention.

DESCRIPTION OF THE PREFERRED EMBODIMENT

In accordance with a preferred embodiment of this invention where similar reference numerals denote similar elements throughout the drawings, there is shown in FIG. 1 a blocking and tackling dummy 10 having on its front side 12 a representation of a football player 14, preferably in color and illustrated to resemble a player of age and size appropriate to the users of the dummy. The dummy 10 including its size, height, weight, feel and cross-section should approximate that of an opposing player as far as possible.

The dummy 10 is composed of a central vertically extending rigid cylindrical tube 16 made from PVC (polyvinylchloride) or the like. The tube 16 is preferably hollow except as will be described subsequently.

Surrounding tube 16 is a layer of dense or hard foam material 18, which in turn is surrounded by a layer of less dense or soft foam 20. The exact consistency of the foam should be selected in accordance with the user in mind, and a combination of differing density foams is preferred. The dummy is covered with a cover 22 of canvas, heavy nylon, vinyl or the like. To enhance replacement of a worn cover, a zipper 24 extends along the top and back of the dummy 10. To enhance portability of the dummy 10, handles 26 are attached to cover 22 in a manner so as to prevent tearing of the cover 22. The dummy 10 is substantially rectangular as seen from its top in FIG. 2, but with its corners tapered instead of square, so as to permit the arms of a user to surround the dummy 10 as if it were a person.

In order to stabilize the dummy 10, produce a low center of gravity and prevent toppling of the dummy unnecessarily, an appropriate quantity of sand or the like, shown as reference numeral 28 in the form of a sandbag, is inserted and secured into the bottom of tube 16. A replaceable base plate 29 of metal, wood, dense hard foam material or the like may also be inserted into the bottom of tube 16 for added weight and/or stability.

Shown in FIG. 3 as reference numeral 30 is a pressure sensitive switch located in the front portion of the dummy 10 and positioned to extend approximately from the knees to the waistline or naval of the football player 14 illustrated on the front of cover 12. Also contained within the dummy 10 is a mercury switch 32 (FIG. 4) and an electronics package 34 (FIG. 3) to be described subsequently. Electrical connections between the various components are easily accomplished within the dummy 10 and are not shown.

The pressure sensitive switch 30 is shown in detail in FIGS. 6, 7, 8 and 9. Two thin plates or metal sheets 36, 38 of conducting metal such as steel or dimpled aluminum are arranged parallel to each other. Each of the plates 36, 38 has a plurality of raised projections 40. The plates are facing and configured so that the raised projections 40 are opposite each other and form a plurality of opposed pairs. A compressible foam pad 42 is positioned between the plates 36 and 38, the pad having formed therein a plurality of circular holes 44 which are each positioned between pairs of raised projections 40. One of the plates is arranged parallel with the front 12 of dummy 10.

As shown best in FIG. 7, when a user of the dummy 10 hits the dummy and presses against plate 38 with sufficient force, the plate 38 will move or flex so that one or more of the raised pairs of projections 40 come into contact with the opposed projection on plate 36. The dimpled aluminum plates make the sensing of pressure over the preferred zone very precise. The amount of force can be varied by varying the thickness and construction of the plates 36, 38 and of the foam pad 42, and should be such as would be produced when the dummy 10 is blocked or tackled appropriately within the preferred zone between the knees and waist as previously described. Contact between the projections 40 of the two plates 36 and 38 will complete and electrical circuit and cause a sensory output such as the sounding of a buzzer to be generated. In FIG. 7 the sensor switch 30 is shown as enclosed within a plastic bag 46 to prevent moisture or other contaminants from affecting the operation of the switch.

Electrical circuitry to cause the sensory output is shown in FIGS. 10 and 11. In FIG. 10 a source of d.c. power such as two 9 volt batteries 50 and 52 are connected in a circuit which includes a buzzer 54. The mercury switch 32 showing therein the movable ball of mercury 56 is also in series with the buzzer 54, the batteries 50, 52 and the sensor switch 30. As configured, closing of the sensor switch 30 as previously described will close the series circuit and permit current flow to actuate buzzer 54, providing an audible output when the dummy 10 has been hit as desired. However if the dummy 10 is tipped or knocked down resulting from a hit above the waist, the mercury 56 in switch 32 will move away from the switch contacts 58, 60 causing the circuit to be open and the buzzer 54 cannot be actuated even if the sensor switch 30 is thereafter closed, such as by a user knocking over the dummy 10 and then falling on top of the dummy 10 in the preferred zone.

In FIG. 11 the buzzer 54 is replaced by a printed circuit board 62 having connected therewith a speaker 64. In this embodiment a hit in the preferred zone of dummy 10 which closes sensor switch 30 will energize the board 62. The board 62 can contain circuitry which simulates a human voice, such output being fed to speaker 64. Any appropriate voice output can be programmed, but a preferred simulated voice is the grunt which is commonly produced when a football player is blocked or tackled.

The circuitry of FIGS. 10 or 11 can be part of the electronics package shown as reference numeral 34 in FIG. 3, or if desired the electronics package can be better protected within the foam layers 18,20 within dummy 10, with the speaker 64 perhaps located at the top of tube 16.

While the invention has been described with respect to preferred embodiments thereof, it is apparent that changes can be made to the structure and arrangement of its elements without departing from the scope of the invention as hereinafter claimed.

What is claimed is:

1. A football blocking and tackling dummy comprising:

a) a vertically extending elongated rigid cylindrical member;

b) a first layer of high density foam material surrounding said cylindrical member;

c) a second layer of lower density foam material surrounding said first layer;

d) an outer covering of strong, flexible material completely covering said second layer;

e) a full length picture of a football player imprinted on the outside of said outer covering;

f) a first switch comprising a pressure sensitive mechanism located within said dummy in a preferred zone between the knees and the waist of a football player imprinted on said outer covering;

g) electrical circuit means including said first switch for producing a sensory output when a user of said dummy impacts said dummy in the said preferred zone and causes actuation of said first switch; and h) a second switch connected with said electrical circuit means and located within said dummy substantially above said first switch and actuable when a user of said dummy impacts said dummy above the said preferred zone, actuation of said second switch immediately prior to actuation of said first switch preventing said electrical circuit from producing said sensory output.

2. A football blocking and tackling dummy as in claim 1 in which said first switch comprises a pair of facing parallel metallic plates separated by a compressible insulator, the striking of one of said plates with sufficient force causing said switch to close.

3. A football blocking and tackling dummy as in claim 2 in which each of said plates has raised projection thereon which oppose the raised projections on the other said plate, and in which said compressible insulator is a layer of foam having holes therein which align with the projection of said plates.

4. A football blocking and tackling dummy as in claim 1 in which said second switch is a normally closed mercury switch positioned at an angle of approximately 30 degrees relative to the ground when said dummy is standing, the mercury in said switch moving away from its normal position and causing said second switch to open when said dummy is tipped backwards or is knocked to a substantially horizontal position.

5. A football blocking and tackling dummy as in claim 1 where the closing of said first switch when said second switch is closed actuates a sound producing element.

6. A football blocking and tackling dummy as in claim 5 in which said sound producing element is a buzzer.

7. A football blocking and tackling dummy as in claim 5 in which said sound producing element is simulated voice apparatus including a speaker.

8. A football blocking and tackling dummy as in claim 1 and further including a weight located within said cylindrical member at the bottom of said dummy to stabilize said dummy in its upright position.

* * * * *